United States Patent [19]

Schroeder

[11] Patent Number: 4,765,072

[45] Date of Patent: Aug. 23, 1988

[54] DIRT DEFLECTOR OVERTRAVEL MECHANISM

[75] Inventor: Philip W. Schroeder, Derby, Kans.

[73] Assignee: J. I. Case Company, Racine, Wis.

[21] Appl. No.: 16,163

[22] Filed: Feb. 18, 1987

[51] Int. Cl.[4] ..... E02F 3/14

[52] U.S. Cl. ..... 37/191 A; 37/86

[58] Field of Search ..... 171/16, 19, 63, 64, 171/65; 37/83, 86, 191 A, 192 A, 191 R

[56] References Cited

U.S. PATENT DOCUMENTS

| | | | |
|---|---|---|---|
| 594,141 | 11/1897 | Nettelbeck | 37/86 |
| 1,566,625 | 12/1925 | Spears | 37/86 |
| 1,868,515 | 7/1932 | Barber | 37/86 |
| 3,011,278 | 12/1961 | Lust | 37/86 |
| 3,209,473 | 10/1965 | Davis | 37/86 |
| 3,316,666 | 5/1967 | Speno | 171/16 |

FOREIGN PATENT DOCUMENTS

| | | | |
|---|---|---|---|
| 863673 | 3/1961 | United Kingdom | 37/86 |

*Primary Examiner*—Robert A. Hafer

*Assistant Examiner*—Samuel Rimell

*Attorney, Agent, or Firm*—Cullen, Sloman, Cantor, Grauer, Scott & Rutherford

[57] ABSTRACT

A dirt deflector overtravel mechanism for a digging boom assembly which permits raising and lowering of the dirt deflector when the deflector is impacted by a rock or the like. The dirt deflector is pivotally attached at one end to a frame. A deflector link is pivotally attached at one end to the boom frame and its opposite end supports the dirt deflector. The opposite end of the deflector link is also pivotally attached to an overtravel link which, in turn, is pivotally attached to the deflector such that it remains in close proximity to the deflector under normal conditions. When a large rock or the like is thrown against the dirt deflector by the digging chain, the deflector link and overtravel link move from a scissors-like position to a colinear position which permits the dirt deflector to be displaced thereby preventing breakage or damage to the deflector. After the impact and displacement of the dirt deflector, the deflector will automatically fall back into place under its own weight.

1 Claim, 1 Drawing Sheet

Fig-4
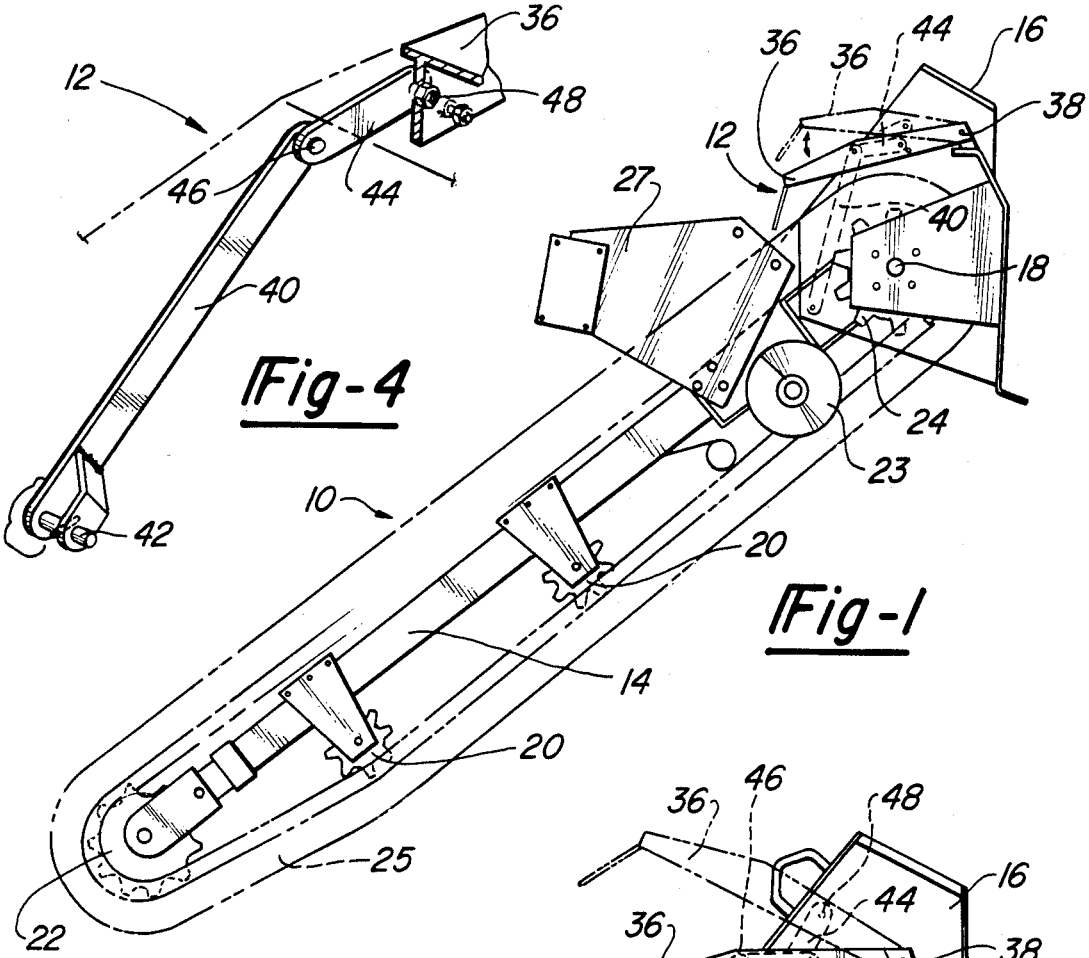
Fig-1
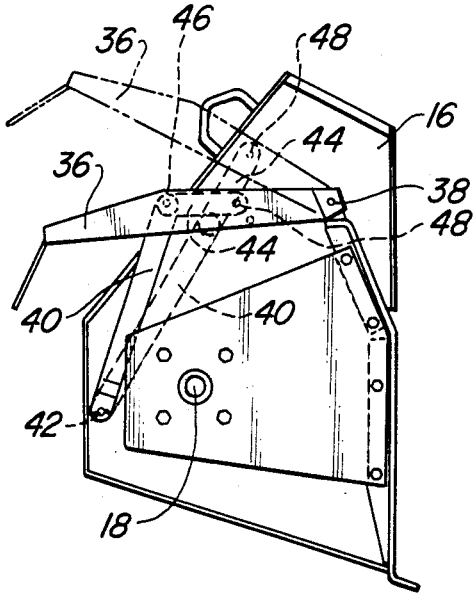
Fig-2
Fig-3
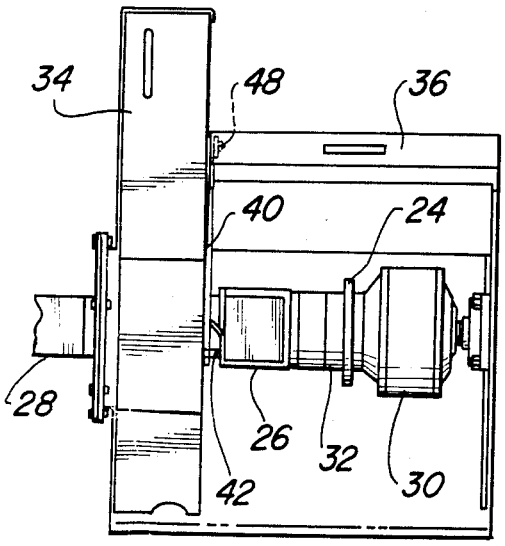

DIRT DEFLECTOR OVERTRAVEL MECHANISM

BACKGROUND OF THE INVENTION

The present invention relates to a dirt deflector overtravel mechanism for a digging boom assembly which permits the raising and lowering of a dirt deflector when the deflector is impacted by a rock or the like.

It is conventional in trenching operations to provide a dirt deflector in the area of the digging chain. The dirt deflector may be attached so that it does not move or a spring cushion may be attached to the dirt deflector. If the dirt deflector includes a solid connection, the deflector may be severely damaged if a large rock is thrown against it by the digging chain. A spring cushion assembly permits the dirt deflector to move as it is struck by rocks and the like, however, this mechanism is also subject to breakage and does not always permit sufficient movement of the deflector during impact.

Thus, the disadvantages of conventional dirt deflector attachments for trencher digging booms have resulted in the present dirt deflector overtravel mechanism which permits the raising and lowering of the dirt deflector when the deflector is impacted.

SUMMARY OF THE INVENTION

A dirt deflector overtravel mechanism made in accordance with the teachings of the present invention is disclosed in connection with a conventional digging boom assembly. The digging boom is pivotally attached to a trencher frame and includes a plurality of sprockets along its length for supporting a digging chain.

The dirt deflector is pivotally attached at one end to the trencher frame. A deflector link is pivotally attached at one end to a pin on the boom frame and its opposite end is pivotally attached to an overtravel link. The overtravel link is pivotally connected to the deflector such that under normal conditions, the overtravel link remains in close proximity to the dirt deflector.

The deflector link provides support to the dirt deflector and permits raising and lowering of the deflector as the digging boom is raised and lowered. When a large rock or the like is thrown against the dirt deflector by the digging chain, the deflector link and overtravel link move into a generally colinear relationship which permits the dirt deflector to be displaced thereby preventing breakage or damage to the deflector.

After impact and displacement of the dirt deflector, the deflector will fall back into place under its own weight. The deflector link and overtravel link are pivotally connected to the deflector at a location which is relatively close to the pivot point for the deflector such that the weight of the deflector will cause the deflector link and overtravel link to rotate. This results in the rotation of the links away from the digging chain and the rotation of the overtravel link back into close proximity with the deflector. Thus, the arrangement and configuration of the dirt deflector overtravel mechanism is uncomplicated and eliminates the need for a spring to return the deflector to its normal position.

Other advantages and meritorious features of the dirt deflector overtravel mechanism will be more fully understood from the following description of the invention, the appended claims, and the drawings, a brief description of which follows.

DESCRIPTION OF THE DRAWINGS

FIG. 1 is a side elevational view of a digging boom assembly including the dirt deflector overtravel mechanism of the present invention.

FIG. 2 is a side elevational view of the dirt deflector mechanism illustrating its raised and lowered positions.

FIG. 3 is a partial front view of the digging boom assembly including the dirt deflector mechanism.

FIG. 4 is a partial perspective view illustrating the dirt deflector, deflector link, and overtravel link.

DESCRIPTION OF THE INVENTION

A digging boom assembly 10 including a dirt deflector overtravel mechanism 12 made in accordance with the teachings of the present invention is illustrated in FIGS. 1–4. The digging boom 14 is pivotally attached to a trencher frame 16 at boom pivot 18. Digging boom 14 includes a plurality of sprockets 20 along its length and sprockets 22 and 24 on its opposite ends. A digging chain 25 is supported by sprockets 20, 22, 24 with chain 25 being driven at sprocket 24, as is conventional. As is also conventional, an auger 23 is connected to boom 14 and mounting structure 27 is provided for mounting a crumber attachment (not shown).

Referring to FIG. 3, the digging boom 14 is pivotally attached at hub 26. Further, a hydraulic motor 28 is operably connected to a planetary trencher drive 30 for driving digging chain hub 32 which, in turn, mounts drive sprocket 24. The boom 14 is lifted and lowered by a cylinder and crank assembly (not shown) which is contained within housing 34 with the crank (not shown) being operably connected to hub 26. All of the just described structure for driving the digging chain 25 and lifting and lowering the digging boom 14 is conventional and only forms the environment of the present invention.

Referring now to FIGS. 2 and 4, a dirt and debris deflector 36 is pivotally attached at one end to frame 16 by pin 38. A deflector link 40 is pivotally attached at one end to pin 42 and its opposite end supports the dirt deflector 36 as shown in FIG. 2. The opposite end of link 40 is also pivotally attached to overtravel link 44 by pin 46. Overtravel link 44 is pivotally connected to deflector 36 by pin 48 such that it remains in close proximity to deflector 36 under normal conditions. The operation of dirt deflector overtravel mechanism 12 will now be described in connection with FIG. 2.

Deflector link 40 provides support to the dirt deflector 36 while permitting raising and lowering of the deflector as the digging boom 14 is raised and lowered. Further, when a large rock or the like is thrown against the dirt deflector 36 by digging chain 25, links 40 and 44 move from the scissors-like solid line position shown in FIG. 2 to the colinear phantom line position shown in FIG. 2 which permits the dirt deflector 36 to move from the solid to phantom line position thereby preventing breakage or damage to the dirt deflector 36.

After impact and displacement of the dirt deflector 36 to the phantom line position in FIG. 2, the dirt deflector 36 will fall back into place under its own weight. Links 40 and 44 are pivotally connected to deflector 36 at a location which is relatively close to pin 38 such that the weight of the deflector 36 will cause link 40 to rotate counterclockwise and cause link 44 to rotate clockwise from the colinear phantom line position of FIG. 2. This causes the rotation of links 40 and 44 away from digging chain 25, the rotation of link 44 back into close proximity with deflector 36, and the rotation of link 40 into a supporting relationship with respect to deflector 36. Thus, the arrangement and configuration of the dirt deflector overtravel mechanism 12 is uncomplicated and eliminates the need for a spring to return the deflector to its normal position.

It will be apparent to those skilled in the art that the foregoing disclosure is exemplary in nature rather than limiting, the invention being defined by the appended claims.

What is claimed is:

1. In a digging boom assembly including a digging boom that is pivotally attached to a frame and a rotatable digging chain supported by said digging boom, the improvement comprising:

a deflector means pivotally attached at one end to said frame and said deflector means having a free end;

said deflector means supported adjacent said digging chain by one end of a deflector link;

said deflector link pivotally attached at said one end to one end of an overtravel link, and the opposite end of the overtravel link pivotally connected to said deflector means adjacent to the pivotal attachment of said deflector means to said frame;

the entire length of said overtravel link being positioned in close proximity to said deflector means when said deflector means is in a first position wherein it is supported by the one end of said deflector link;

said deflector link and said overtravel link moving into colinear relationship upon said deflector means being impacted by a rock or the like thereby permitting said deflector means to move to a second position; and the deflector means moving under its own weight from said second position to said first position for rotating said deflector link and said overtravel link whereby said links are rotated relative to said digging chain, and the deflector link is rotated in response to the weight of the deflector means such that its one end again supports said deflector means and said overtravel link is rotated such that its length is in close proximity to said deflector means.

* * * * *